US005419090A

United States Patent [19]

Sandow

[11] Patent Number: 5,419,090

[45] Date of Patent: May 30, 1995

[54] SKYLIGHT GUARD ASSEMBLY

[76] Inventor: Kiyoshi Sandow, P.O. Box 24158, Houston, Tex. 77229

[21] Appl. No.: 146,604

[22] Filed: Nov. 2, 1993

[51] Int. Cl.[6] ..... E04B 7/18

[52] U.S. Cl. ..... 52/200

[58] Field of Search ..... 52/200, 106, 202; 41/50, 463

[56] References Cited

U.S. PATENT DOCUMENTS 1,233,530 7/1917 Whitnell .

*Primary Examiner*—Carl D. Friedman
*Assistant Examiner*—Creighton Smith
*Attorney, Agent, or Firm*—Kenneth E. Kuffner

[57] ABSTRACT

A skylight guard assembly comprising a galvanized sheet metal rail having first and second side members and a cross brace member connected to the top surface of a corrugated plastic panel rib, a metal screen fixedly attached to the top of the rail to prevent the danger of injury from stepping or falling through a corrugated plastic panel skylight in a corrugated metal roof, means for connecting the metal screen to the rail, and means for attaching said rail to an adjacent corrugated metal panel, wherein the rail holds the metal screen a spaced distance above the corrugated plastic panel to avoid buildup of water and trash.

15 Claims, 3 Drawing Sheets

SKYLIGHT GUARD ASSEMBLY

BACKGROUND OF THE INVENTION

This invention relates to safety guard assemblies for skylights. More particularly, the invention relates to safety guard assemblies for corrugated fiberglass reinforced plastic panels used to admit daylight through corrugated metal roofs.

For over thirty-five (35) years, translucent corrugated fiberglass reinforced plastic panels have been used to replace corrugated metal roof panels as a means for admitting daylight into the interior of buildings. Typically, only certain individual corrugated metal panels are replaced so that a sequence of alternating metal and plastic panels is created. In this manner, each plastic panel is encompassed and supported by adjacent metal panels. In addition, locating the plastic panels or skylights evenly over the roof provides an even illumination throughout the building. Since corrugated metal panels are made of a thin, light gauge sheet metal, the thickness of the corrugated plastic panels must also be of a light gauge in order to work in conjunction with the corrugated metal panels. A light gauge plastic panel is also necessary to allow enough passage of light to be effective as a skylight.

Corrugated plastic panels are usually reinforced with a fiberglass mat for additional strength. Since corrugated plastic panels must be made of a light gauge to begin with, the plastic resin used in these corrugated plastic panels is typically not light stable and can become brittle and suffer discoloration after a few years of ultraviolet exposure. After the plastic panel becomes brittle, the only significant material left to provide strength is the layer of fiberglass mat. However, the layer of fiberglass mat alone will not support the weight of a person.

For all of the reasons set out above, a person stepping onto a roof containing one or more corrugated plastic panels may be in real danger. Although a prudent person would be able to avoid intentionally stepping on such panels that he was aware of, there are a number of reasons for which a person might accidentally step on a weakened or embrittled plastic panel. For example, the plastic panels are at the same level as the rest of the roof and are not readily identifiable by looking at the roof, especially if the corrugated plastic panel has been painted to match the corrugated metal panel. Corrugated plastic panels are sometimes painted over when they become ineffective as a skylight due to the discoloration of the plastic panel. Moreover, if there is a thin layer of ice, snow, leaves or other debris on the roof a person can easily step or slide onto a corrugated plastic panel. If the panel is not strenthened or otherwise secured, there is a real hazard that a person may fall through.

The National Institute for Occupational Safety and Health (NIOSH) reports, in NIOSH Publication No. 90-100, that during the period 1980–85, 28 deaths resulted from falls through skylights and 39 deaths resulted from falls through roofs or roof openings. This danger is corroborated by the reports of the Occupational Safety and Health Agency (OSHA) which records the incidence of industrial and work related injuries. Report No. 91-660 describes an accident which occured in Grand Island, Nebr. to a painting contractor. The report states that the "[e]mployee was walking along a roof when he stepped into a roof skylight. He fell through the fiberglass skylight, 22 feet to the lower level, and was killed in the fall." A second report sets out a similar accident involving an employee of a refractory manufacturer. This report states that "[w]hile he was walking around a roof, victim stepped on a fiberglass covered skylight opening. He fell 25 feet to the floor below and was fatally injured."

Another OSHA report, ID 0352410, describes another incident as follows:

> Several employees were reskinning a metal roof . . . located 20 feet above a concrete floor. The roof contained 8 uncovered fiberglass skylights, 11 feet by 3 feet. Employee #1, the foremen, had warned the other employees to be careful around the skylights. The job was 50% complete. It was a Friday, and the employees had started to clean up. Employee #1 dumped the water cooler and started to walk across the roof. He stepped onto a skylight and fell through it to the concrete floor. He died of massive head injuries. The skylights were not covered or otherwise guarded, and were painted the same color as the roof.

As a result of these and many other accidents involving skylights, OSHA has recognized the dangers posed by skylights and has promulgated requirements for a standard skylight screen in 29 C.F.R. 1910.23(e)(8) as follows:

> Skylight screens shall be of such construction and mounting that they are capable of withstanding a load of at least 200 pounds applied perpendicularly at any one area on the screen. They shall also be of such construction and mounting that under ordinary loads or impacts, they will not deflect downward sufficiently to break the glass below them. The construction shall be of grillwork with openings not more than 4 inches long or of slatwork with openings not more than 2 inches wide with length unrestricted.

The number of deaths and the resulting OSHA regulation illustrate that there exists a definite need for a cost effective means of guarding against falls through corrugated fiberglass skylights. The present invention is a skylight guard assembly that will prevent such tragic accidents from occurring.

SUMMARY OF THE INVENTION

The invention provides a skylight guard assembly for use over corrugated plastic panel skylights in corrugated metal roof buildings. The skylight guard consists of a light gauge steel or extruded aluminum channel. The channel is fastened with the legs facing downward to allow it to straddle the corrugations of the plastic panel and corrugated metal roof panels. The channel is fastened to the top of the corrugation nearest to the center of the corrugated metal panel or alternatively along each side of the panel.

In the manner described, a welded wire mesh is fixedly held in a position that is a spaced distance above a corrugated plastic panel to prevent the weight of a person on the steel mesh from impacting or breaking the plastic panel and causing injury. The metal channel elevates the skylight screen above the plastic panel allowing for passage of water and debri without restricting the passage of daylight. The channel is fastened to the corrugated metal panels at both the upper and lower ends of the skylight panel. The metal and fiberglass panels are supported above a series of purlins which extend between the I-beams. When weight is placed on the wire mesh, the wire will deflect downward until it finds adequate support from the channel, surrounding metal panels, and underlying purlins or I-beams. Therefore, a person who accidentally steps, slides, or falls onto a plastic skylight with a skylight screen of the present invention will avoid serious injury or a deadly fall.

A first embodiment comprises two extruded aluminum rails in the form of H beams having a continuously serrated slot disposed along a top edge. Connecting means are provided for attaching the rails to a rib of a corrugated metal panel adjacent to the plastic panel. A welded wire mesh cover is secured to the rails so as to extend over the plastic panel. The mesh cover has a perimeter edge, a plurality of spaced cross wires and a plurality of spaced longitudinal wires. The mesh cover is larger than the opening created if the plastic panel were removed. A plurality of metal staples fixedly attach the cross wires of the mesh cover to the rails. Each staple is held in cooperation with the serrated slot in the rail. Optionally, a plastic bumper may be disposed around the perimeter edge of the welded wire mesh. The preferred embodiment involves the use of only one channel placed down the center of a skylight and having a series of raised tabs for attachment of the wire mesh. This arrangement eliminates one channel, allows a lighter gauge mesh to be used, since the mesh spans a much shorter distance, and greatly simplifies installation.

BRIEF DESCRIPTION OF THE DRAWINGS

A more particular description of the invention, briefly summarized above, may be had by reference to the embodiment thereof which is illustrated in the appended drawings.

It is to be noted, however, that the appended drawings illustrate only the preferred embodiments of this invention and are therefore not to be considered limiting of its scope, for the invention may admit to other equally effective embodiments.

DETAILED DESCRIPTION OF THE INVENTION

This invention permits retrofitting of existing corrugated plastic panel skylights with a protective welded wire mesh skylight screen to prevent falls through the corrugated plastic panel. The skylight guard assembly of the present invention has the advantage of flexible installation with regard to corrugated plastic panels of various widths and lengths. A metal rail or channel may be cut to length according to the desired application. Accordingly, a welded wire mesh cover 18 may be cut to such widths and lengths as the corrugated fiberglass plastic panel requires. However, the invention requires that the wire mesh skylight screen be larger than the opening that would exist if the plastic panel were removed. It will be apparent to one with ordinary skill in the art that the material of the channel and the wire mesh may be substituted with such materials as ultraviolet-stabilized plastic composites or other metals.

Figure 1:
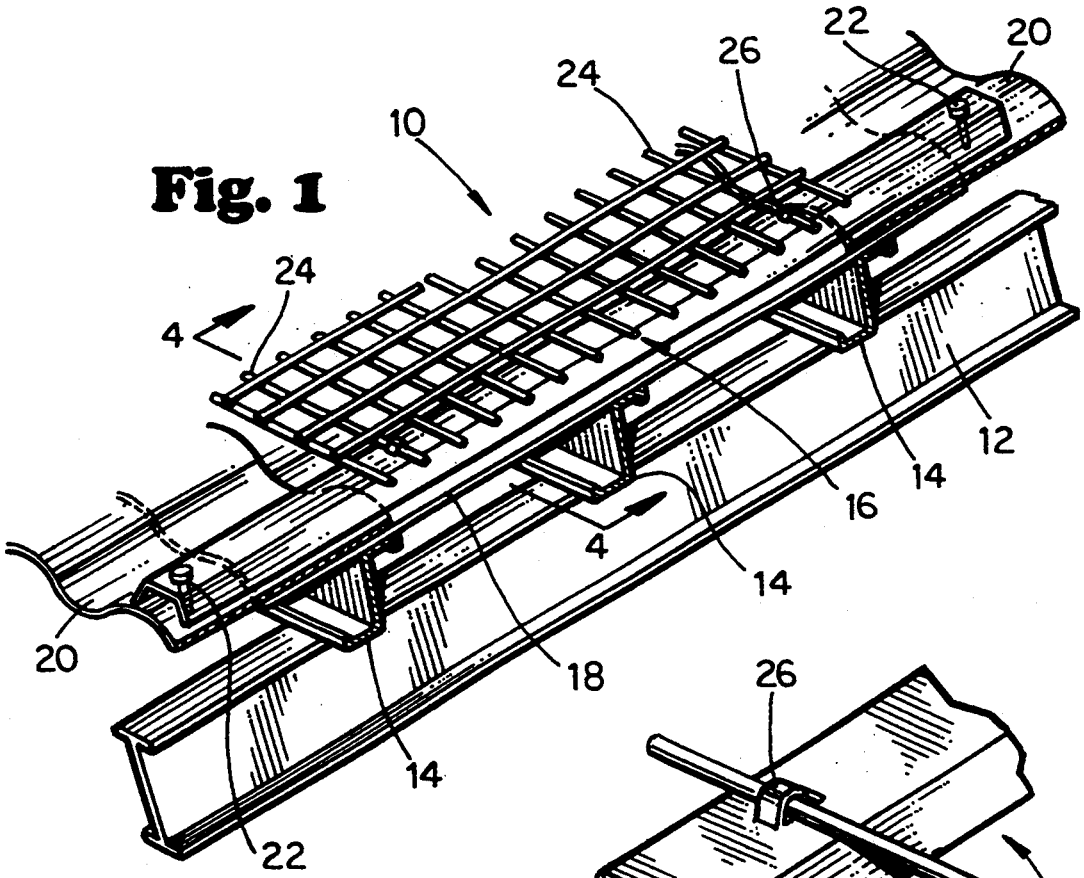
FIG. 1 is a cross sectional view of a roof support structure for a corrugated metal roof having I-beams and purlins.
Figure 2:
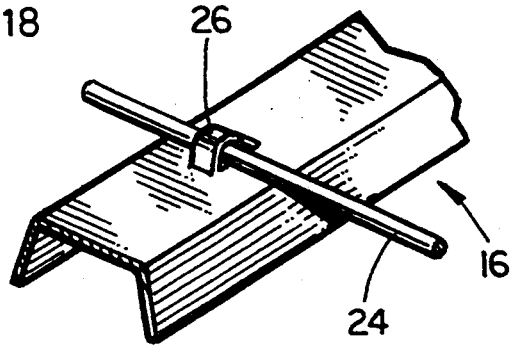
FIG. 2 is a perspective view of the tab arrangement for fastening a crosswire in the mesh to the channel.
Figure 3:
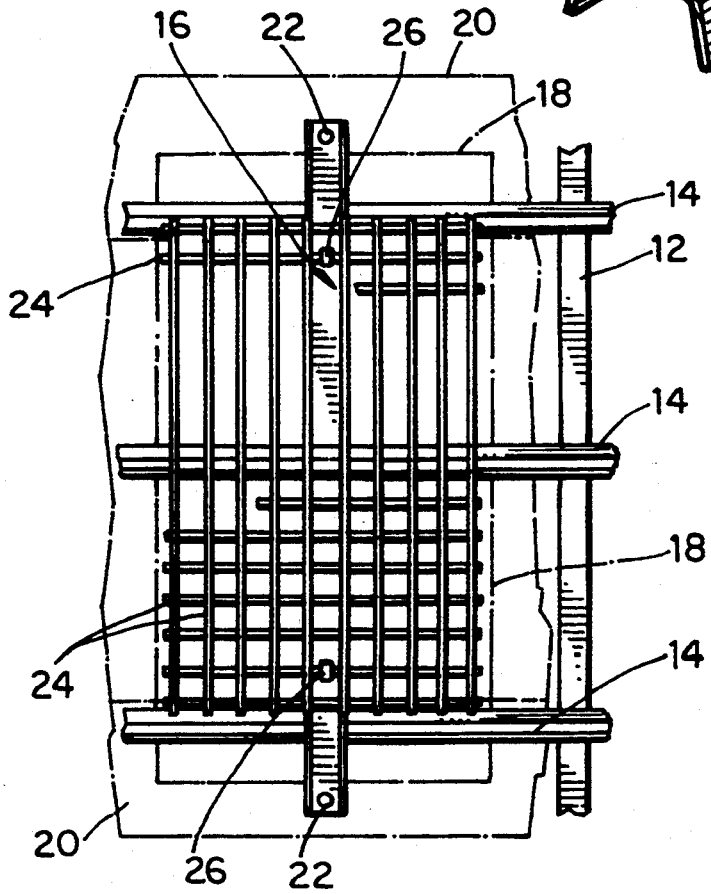
FIG. 3 is a plan view of the invention showing the central placement of a channel and its attachment to adjacent metal roof panels.

The preferred embodiment of the present invention is shown in FIG. 1 to FIG. 3. Referring to FIG. 1, a skylight screen 10 is shown mounted above the support structure of a corrugated panel roof is shown. An I-beam 12 extends upward at an angle from a side wall to the peak of the building. Purlins 14 are typically spaced at 5 foot centers and span between each I-beam 12 over the length of the roof. Three purlins 14 are shown in the parallel arrangement. A metal channel 16 extends upward along the slope of the roof such that the channel 16 is perpendicular to the purlins 14. The channel 16 is placed over the top surface of the corrugated plastic panel 18 and adjacent corrugated metal panels 20. A screw, bolt or other fastening means 22 may be used to fasten the channel 16 to the metal panels 20 and/or the purlins 14. Finally, a welded wire mesh 24 is placed over the channel 16 and held in place by bending a tab 26, which is stamped out of channel 16 (as shown in FIG. 2), over a crosswire in the mesh 24.

Referring now to the plan view of FIG. 3, the skylight screen 10 is shown mounted over the purlins 14. The channel 16 extends between adjacent metal panels, is supported by the purlins 14 and is positioned down the middle of the plastic panel skylight . The channel 16 is preferrably attached to the metal panel 20 at points 30 and 32 to firmly hold it in place.

Figure 4:
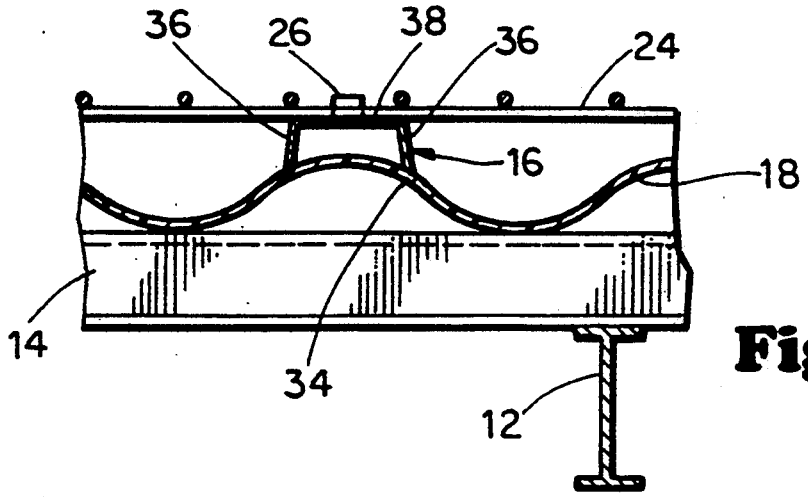
FIG. 4 is a cross sectional detail view of one end of a corrugated roof panel having a skylight screen mounted thereon.

FIG. 4 is an end view of the channel 16 and wire mesh 24 placed on top of a center ridge 34 of the plastic panel 18 and fastened to the purlin 14. The preferred channel 16 has two legs 36 which straddle the ridge 34 to enable easy installation and leveling of the top surface 38 of the channel 16. Only one channel is needed to raise the wire mesh or screen off the corrugated roof sufficiently to avoid the collection of debri and water. In addition, using a single channel reduces the cost and expense of installing the present invention.

The channel or rail 16 is preferably made of a 16 or 18 gauge galvanized steel which has two legs or side members bent downward and the edges rolled or hemmed to avoid damaging the fiberglass panel. It is also preferred that the top surface or cross brace member of the channel have tabs for securely fastening the metal wire mesh. One advantage of this arrangement is the inexpensive production of the channel and skylight screen assembly. Another advantage is the simple, unitary construction and simple installation procedures required. A tab (as shown at point 26 of FIGS. 1 and 2) is created by cutting three sides of a rectangular region on the top surface of the channel and leaving the fourth side attached. In this manner, the end of the metal tab may be easily lifted and inserted through an opening in the wire mesh or expanded metal screen, and crimped down to secure the mesh or screen to the channel. The channel may be made with a plurality of tabs along the length and width of the channel. It is preferred that at least two tabs be placed at each end of the channel and be spaced as far apart across the width of the channel as is practical. The spacing of the tabs is preferably determined by the mesh of the screen, ie., the distance between openings between which the tabs may be inserted.

Figure 5:
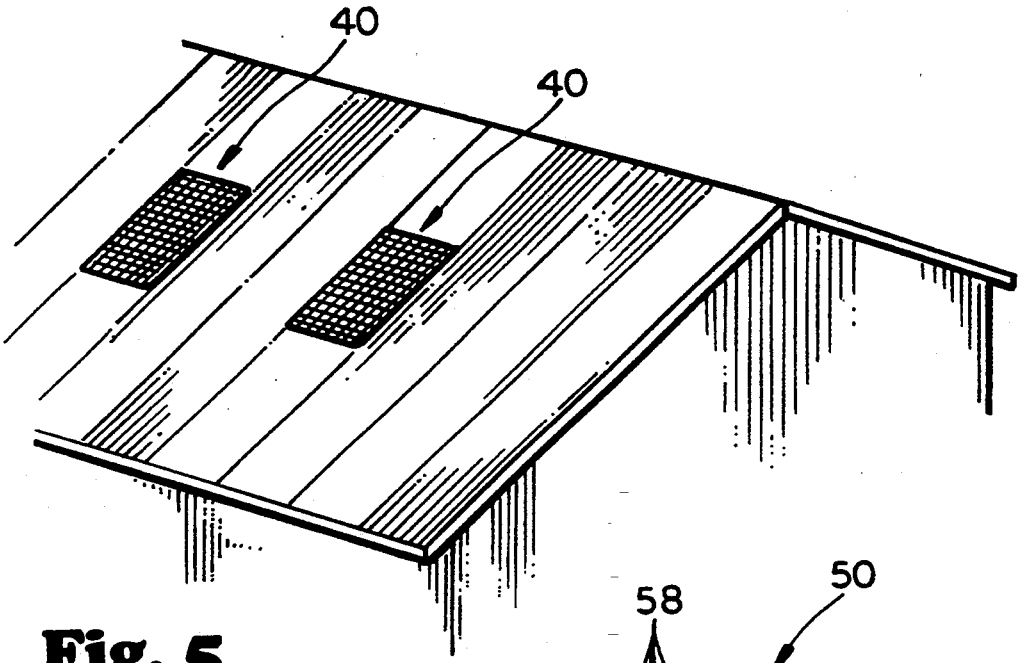
FIG. 5 is a perspective view of metal wire mesh covers mounted on a roof over two corrugated fiberglass panels.

Referring to FIG. 5, a skylight guard assembly 40 is shown in place above a corrugate fiberglass skylight in a corrugated metal roof. The skylights are typically spaced apart by at least one corrugated metal panel for stability and are spaced consistently to admit light more or less evenly throughout the building.

Figure 6:
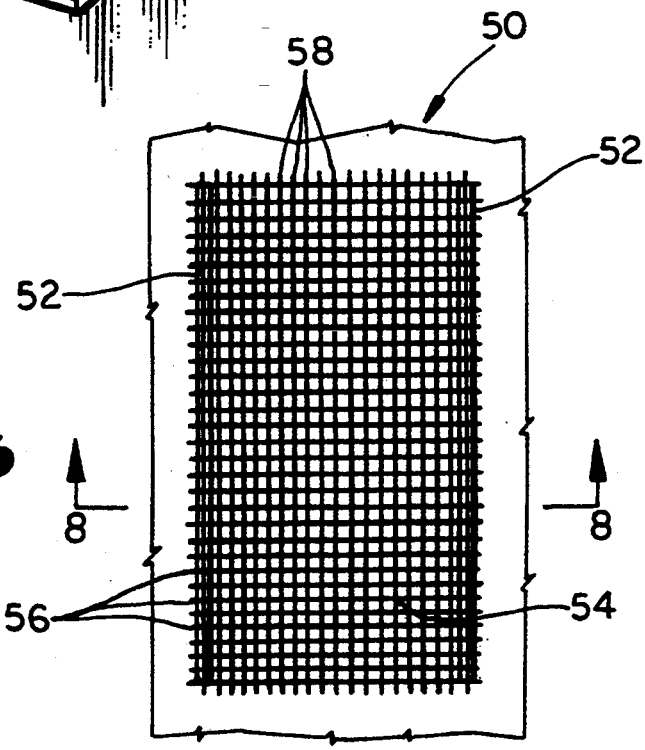
FIG. 6 is a plan view of the invention showing the parallel placement of the two aluminum rails and the placement of the welded wire mesh.

Referring now to the plan view of FIG. 6, a skylight guard assembly 50 is shown generally with two parallel metal or aluminum rails 52 along the sides of the welded wire mesh cover or screen 54. The wire mesh cover 54 is comprised of cross wires 56 and longitudinal wires 58.

Figure 7:
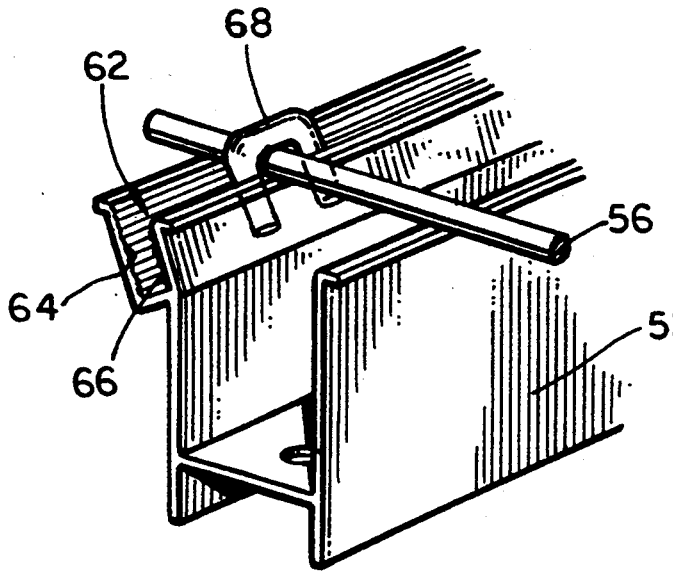
FIG. 7 is a perspective view of an aluminum rail having an exemplary cross wire attached by a staple.

Another embodiment in FIG. 7 shows a serrated metal slot 62 having serrated side walls 64 and 66 formed in a top portion of one leg of the rail 52. A staple 68 works in cooperation with the slot 62 to secure the cross wire 56 to the rail 52. Staples 68 are similarly incorporated along the entire length of the rail 52 to secure all or most of the cross wires 56 (see FIG. 6). Additionally, the plastic bumper guard 60 is shown covering the end of the cross wire 56.

Figure 8:
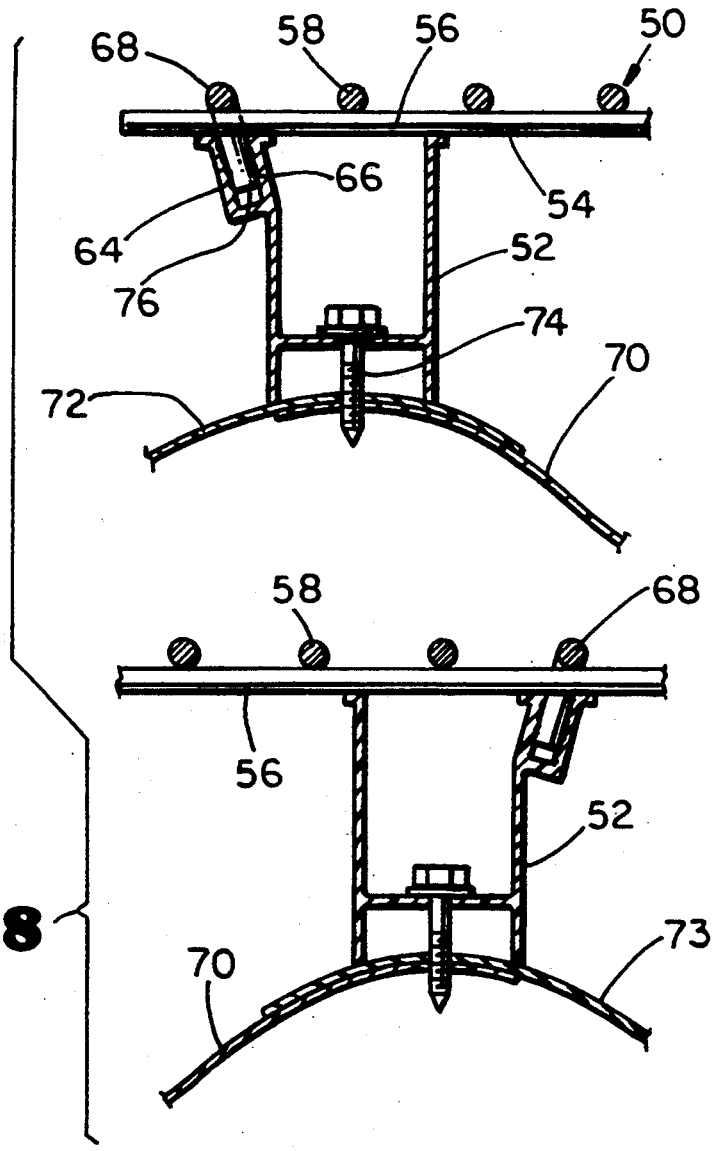
FIG. 8 is a cross sectional detail view of one end of a corrugated fiberglass panel having an H beam rail and metal wire mesh cover mounted thereon.

Referring to FIG. 8, the skylight guard assembly 50 is shown mounted over a corrugated fiberglass panel 70. A single extruded aluminum rail 52 is shown attached to a rib of a corrugated metal panel 72 by connecting means 74. As shown in FIG. 8, the connecting means 74 may take the form of a metal screw. However, one with skill in the art will understand that connecting means may take alternative forms such as rivets, bolts, or even adhesive means.

A welded wire mesh cover 54 is disposed above the rail 52. The wire mesh is comprised of a plurality of spaced cross wires 56 and plurality of longitudinal wires 58. As shown in FIG. 7, it is preferred that the cross wires 56 be made of a heavier gauge metal than the longitudinal wires 58 in order to provide sufficient support of the mesh, and the weight of a person, across the distance spanning between the rails 52. It is also preferred that the cross wires and the longitudinal wires be spaced less than four inches apart.

To hold the metal wire mesh 54 in place above rail 52, a plurality of metal staples 68 are placed astride of several cross wires 56. The staples 68 work in cooperation with a serrated metal slot 76 having serrated side walls 64 and 66 formed in a top portion of one leg of the rail 52. The metal staple 68 is held securely in place upon insertion into the slot 76. The staple 68 is inserted such that the cross wire 56 is held rigidly against the H beam aluminum rail 52. In this manner, the welded wire mesh is fixedly held on the top portions of the H beam of rail 52.

A second rail, identical to rail 52, is attached to a second corrugated metal panel 73 located on the opposite side of the corrugated fiberglass panel 70 from the first metal panel 72. In this manner, the welded wire mesh 54 is held in a parallel plane a spaced distance above the corrugated fiberglass panel 70 to prevent buildup of water and debri between the mesh 54 and the surface of the fiberglass panel 70. In addition, bumper 60 may be disposed around the perimeter edge of the welded wire mesh 54 which generally will take the form of a rectangle.

It will be understood that certain combinations and subcombinations of the invention are of utility and may be employed without reference to other features in subcombinations. This is contemplated by and is within the scope of the present invention. As many possible embodiments may be made of this invention without departing from the spirit and scope thereof, it is to be understood that all matters hereinabove set forth or shown in the accompanying drawing are to be interpreted as illustrative and not in a limiting sense.

While the foregoing is directed to the preferred embodiment, the scope thereof is determined by the claims which follow:

What is claimed is:

1. A skylight safety guard assembly for use over corrugated plastic panels comprising:

a rail having first and second side members and a cross brace member;

means for attaching said rail to an adjacent corrugated metal panel;

a metal screen having a perimeter edge, wherein said rail holds the metal screen a spaced distance above the corrugated plastic panel; and means for connecting the metal screen to the rail;

wherein said metal screen is a welded wire mesh having a plurality of spaced cross wires and a plurality of spaced longitudinal wires, wherein said longitudinal wires are made of a lighter gauge than said cross wires.

2. The skylight guard assembly of claim 1, wherein said metal screen is an expanded metal sheet.

3. The skylight guard assembly of claim 1, wherein said attaching means is a screw.

4. The skylight guard assembly of claim 1, wherein said rail is made from galvanized sheet metal.

5. The skylight guard assembly of claim 1, wherein said rail is a plurality of rails.

6. The skylight guard assembly of claim 1, wherein the first side member of each rail has a continuous serrated slot disposed along a top edge, and wherein each of said rails are positioned with said first side members facing outwardly, and wherein said connecting means is a plurality of metal staples rigidly holding the cross wires of said welded wire mesh to each rail, and wherein each of said staples have two legs held in cooperation with the serrated slot.

7. A skylight for use in a corrugated metal roof comprising:

a corrugated plastic panel;

a rail disposed above said plastic panel having first and second side members and a cross brace member;

means for attaching said rail to a purlin in the metal roof;

a metal screen having a perimeter edge, wherein said rail holds the metal screen a spaced distance above the corrugated plastic panel; and means for connecting said metal screen to said rail.

8. The skylight of claim 7, wherein said metal screen is a welded wire mesh having a plurality of spaced cross wires and a plurality of spaced longitudinal wires, wherein said longitudinal wires are made of a lighter gauge than said cross wires.

9. The skylight of claim 7, wherein said corrugated plastic panel is reinforced with fiberglass.

10. A skylight for use in a corrugated metal roof comprising:

a corrugated plastic panel having a midline;

a rail disposed above said plastic panel having first and second side members and a cross brace member;

means for attaching said rail to a purlin in the metal roof;

a metal screen having a perimeter edge, wherein said rail holds the metal screen a spaced distance above the corrugated plastic panel; and means for connecting said metal screen to said rail, wherein said rail is disposed on a corrugated ridge near the midline of the plastic panel.

11. The skylight of claim 7, wherein said rail is a plurality of rails.

12. The skylight of claim 7, wherein said means for connecting the metal screen to the rail is a tab.

13. The skylight of claim 7, wherein said metal screen is an expanded metal sheet.

14. The skylight guard assembly of claim 7, wherein said rail is made from galvanized sheet metal.

15. A skylight safety guard assembly for use over corrugated plastic panels comprising:

a plurality of H beam rails;

means for attaching said rail to an adjacent corrugated metal panel;

a metal screen having a perimeter edge, wherein said rail holds the metal screen a spaced distance above the corrugated plastic panel; and means for connecting the metal screen to the rail.

* * * * *